US005195632A

United States Patent [19]

Lauterwald

[11] Patent Number: 5,195,632

[45] Date of Patent: Mar. 23, 1993

[54] FORCE-STORING ACTUATOR FOR LOAD SWITCH OF STEP TRANSFORMER

[75] Inventor: Rolf Lauterwald, Pettendorf, Fed. Rep. of Germany

[73] Assignee: Maschinenfabrik Reinhausen GmbH, Regensburg, Fed. Rep. of Germany

[21] Appl. No.: 783,629

[22] Filed: Oct. 25, 1991

[30] Foreign Application Priority Data

Oct. 26, 1990 [DE] Fed. Rep. of Germany ..... 4034126

[51] Int. Cl.[5] ..... H01H 5/10

[52] U.S. Cl. ..... 200/400; 200/324; 200/325

[58] Field of Search ..... 200/324, 325, 400, 401

[56] References Cited

U.S. PATENT DOCUMENTS

| | | | |
|---|---|---|---|
| 2,846,621 | 8/1958 | Coggeshall et al. | 200/401 X |
| 3,183,332 | 5/1965 | Frink et al. | 200/400 |
| 3,848,102 | 11/1974 | Jencks et al. | 200/400 |
| 4,761,524 | 8/1988 | Golowash | 200/400 |
| 5,101,675 | 4/1992 | Lauterwald | 200/400 X |

FOREIGN PATENT DOCUMENTS

| | | |
|---|---|---|
| 3533179 | 3/1987 | Fed. Rep. of Germany . |
| 3626526 | 2/1988 | Fed. Rep. of Germany . |
| 3938207 | 5/1991 | Fed. Rep. of Germany . |

*Primary Examiner*—Stephen P. Garbe
*Assistant Examiner*—Jes F. Pascua
*Attorney, Agent, or Firm*—Herbert Dubno; Andrew Wilford

[57] ABSTRACT

A force-storing actuator for connection to a rotor of a step transformer has a central upright axle connected to the rotor and rotatable about its axis, and upper and lower input wheels fixed rotationally to each other and rotatable on the shaft about the axis. Respective upper and lower drive elements fixed underneath and atop the input wheels flank upper and lower force-storing levers rotatable on the shaft between the input wheels and juxtaposed with the input wheels. Each lever is angularly engageable with the respective drive element. A spring has outer ends connected to the two levers offset from the axis. An output wheel fixed on the shaft above the upper input wheel carries an output element fixed on the shaft axially between the levers and engageable angularly with both of the levers. Latching formations on the output wheel are engageable by at least one latch pawl movable between a blocking position latchingly engaging the formations to angularly arrest the output wheel and a freeing position out of engagement with the output wheel. A cam on the upper drive wheel is engageable with the pawl for displacing it between its positions. When the input wheels are rotated with the pawl in the blocking position the spring is tensioned and the cam is then brought into engagement with the pawl to displace it briefly into the freeing position to allow rotation of the output wheel and shaft and relaxation of the spring.

8 Claims, 6 Drawing Sheets

FORCE-STORING ACTUATOR FOR LOAD SWITCH OF STEP TRANSFORMER

FIELD OF THE INVENTION

The present invention relates to a force-storing snap-type actuator. More particularly this invention concerns such an actuator used to index step transformer.

BACKGROUND OF THE INVENTION

A step transformer has a rotor that is moved angularly in steps to switch the transformer output and/or input to different taps on the transformer. A terminal must be moved from one tap to the next one with the highest possible starting speed to avoid drawing an arc or to break any arc drawn as quickly as possible. It is therefore common to provide a spring-loaded force-storing actuator for such a load switch. Movement of an input element in a direction intended to switch the rotor of the transformer is first merely transferred to this force-storing device to compress and/or extend the spring or springs thereof. Once a critical point is reached, this stored-up spring force is released to snap the rotor angularly to the next position. This therefore allows a relatively slowly moving motor to drive the rotor of the step transformer with the desired snap action.

In copending patent application Ser. No. 07/613,387 I describe such an arrangement for connection to a rotor of a step transformer that has a pair of similar levers rotatable about a common axis and having diametrally opposite outer ends, an input element and an output element rotatable about the axis and operatively engageable with the levers, and a latch device for releasably retaining the output element in any of a plurality of angularly offset positions. Respective springs each have one end connected to a respective end of one of the levers and an opposite end connected to a respective end of the other lever and having a middle between the ends. Respective guides movable freely angularly about the axis between the lever ends at generally the same radial spacing from the axis as the lever ends are connected to the middles of the respective springs. Thus the springs each have a pair of sections flanking the respective guide and extending generally tangentially of a circle centered on the axis from the respective spring ends to the respective spring middles.

Thus the springs are in effect deflected so that they are effective almost purely angularly on the ends of the levers. As a result the mechanism is extremely simple while still giving the desired snap action needed to avoid arc formation in a step transformer.

The main disadvantage of this system is that it is fairly complex and bulky. The complexity makes it difficult and expensive to manufacture. The bulkiness makes accommodating it in the bottom of a standard step transformer fairly difficult.

OBJECTS OF THE INVENTION

It is therefore an object of the present invention to provide an improved actuator for a load switch of a step transformer.

Another object is the provision of such an improved actuator for a load switch of a step transformer which overcomes the above-given disadvantages, that is which has the requisite snap action, but which is fairly simple and compact in construction.

SUMMARY OF THE INVENTION

A force-storing actuator for connection to a rotor of a step transformer according to the invention has a support, a central upright axle connected to the rotor, defining an axis, and rotatable on the support about the axis, and upper and lower input wheels fixed rotationally to each other and rotatable on the shaft about the axis. Respective upper and lower drive elements fixed respectively underneath and atop the upper and lower input wheels flank upper and lower force-storing levers rotatable on the shaft about the axis between the input wheels and respectively juxtaposed with the upper and lower input wheels. Each lever is angularly engageable with the respective drive element. A spring arm rotatable on the shaft about the axis between the upper and lower levers has an outer end engaging the middle of a spring having outer ends connected to the two levers offset from the axis. An output wheel fixed on the shaft above the upper input wheel carries an output element fixed angularly on the shaft axially between the levers and engageable angularly with both of the levers. Latching formations on the output wheel are engageable by at least one latch pawl movable on the support between a blocking position latchingly engaging the formations to angularly arrest the output wheel and a freeing position out of engagement with the output wheel. A cam on the upper drive wheel is engageable with the pawl for displacing same between its positions. When the input wheels are rotated with the pawl in the blocking position the spring is tensioned and the cam is brought into engagement with the pawl to displace it briefly into the freeing position to allow rotation of the output wheel and shaft and relaxation of the spring.

Such an arrangement is extremely compact. It ensures the desired snap action with each stepped rotation of the input elements. The structure returns to the starting position after each angular stepping and can thereafter be operated in either direction.

According to further features of the invention the levers are spectrally identical and the cam includes an upper cam edge and a lower cam edge on the upper drive wheel. The latching formations include upper and lower formations on the output wheel and each of the latch pawls has an upper arm engageable with a respective one of the formations and a lower arm engageable with a respective one of the cam edges.

The drive and output elements according to the invention are elastomeric bumpers and the spring lever is freely pivotal about the axis. The input wheels are also substantially identical.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
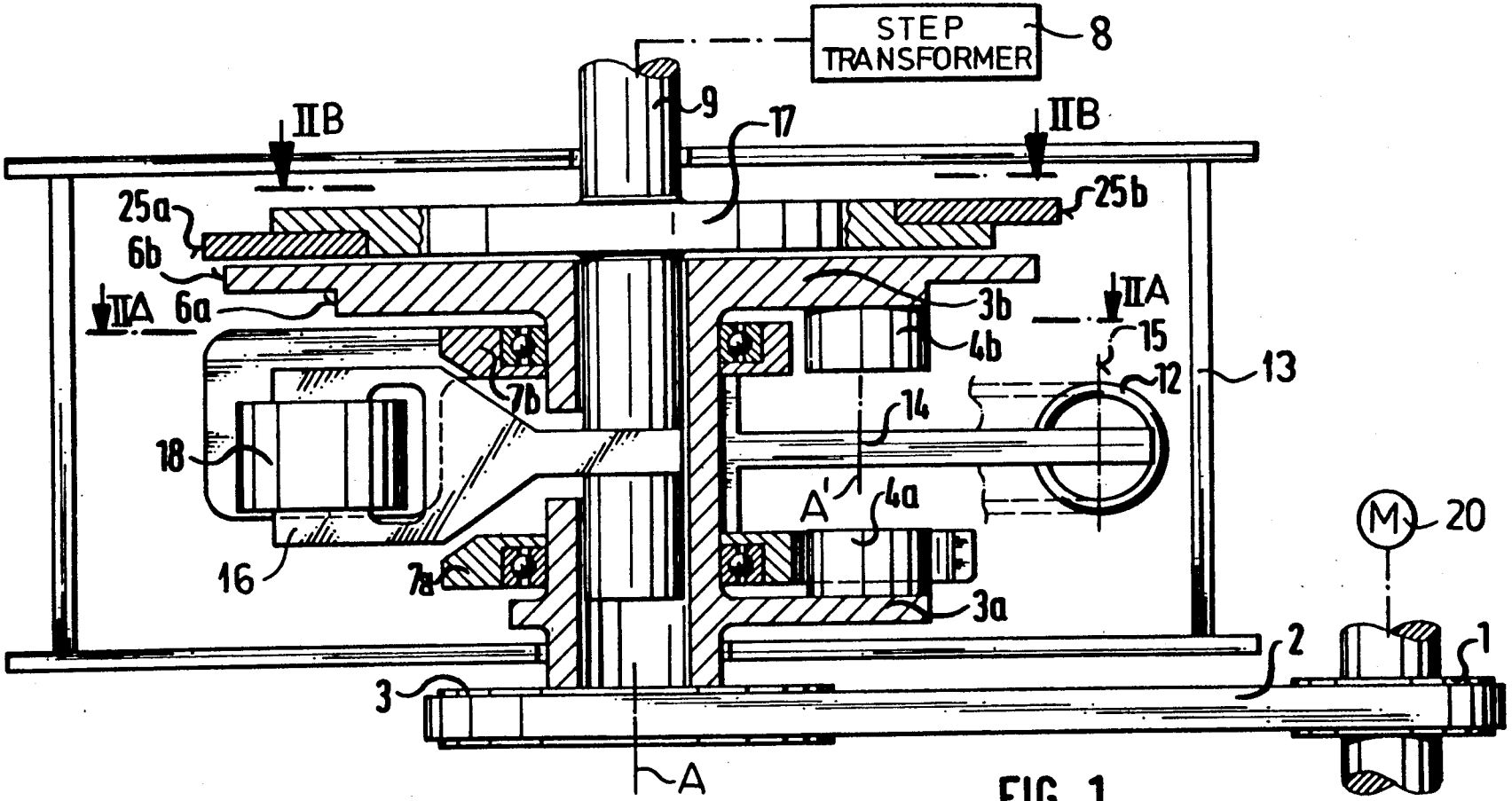
FIG. 1 is a partly diagrammatic vertical section through the system of this invention.
Figure 2B:
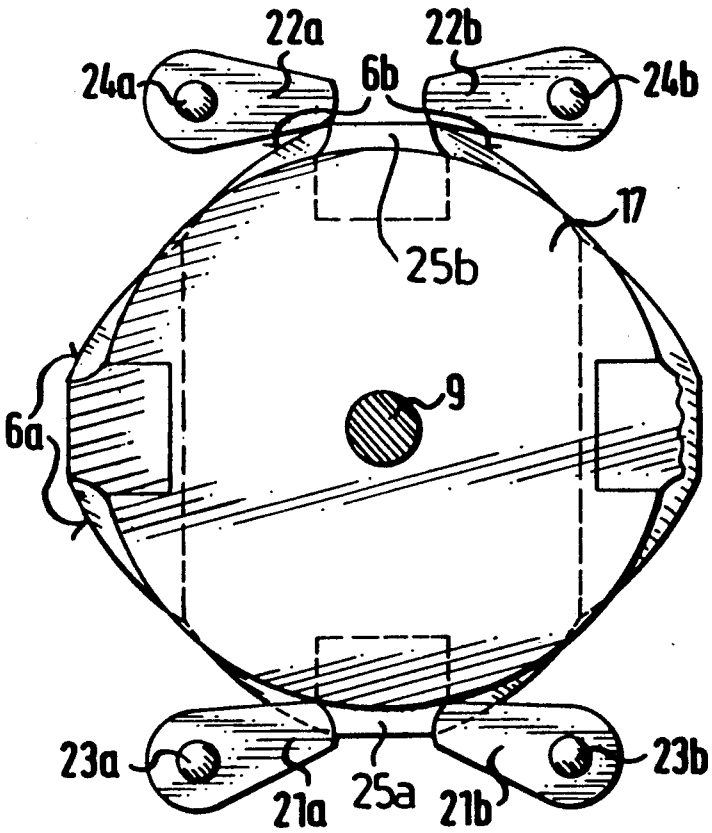
FIGS. 2A and 2B are cross sections taken respectively along lines IIA—IIA and IIB—IIB of FIG. 1.
Figure 2A:
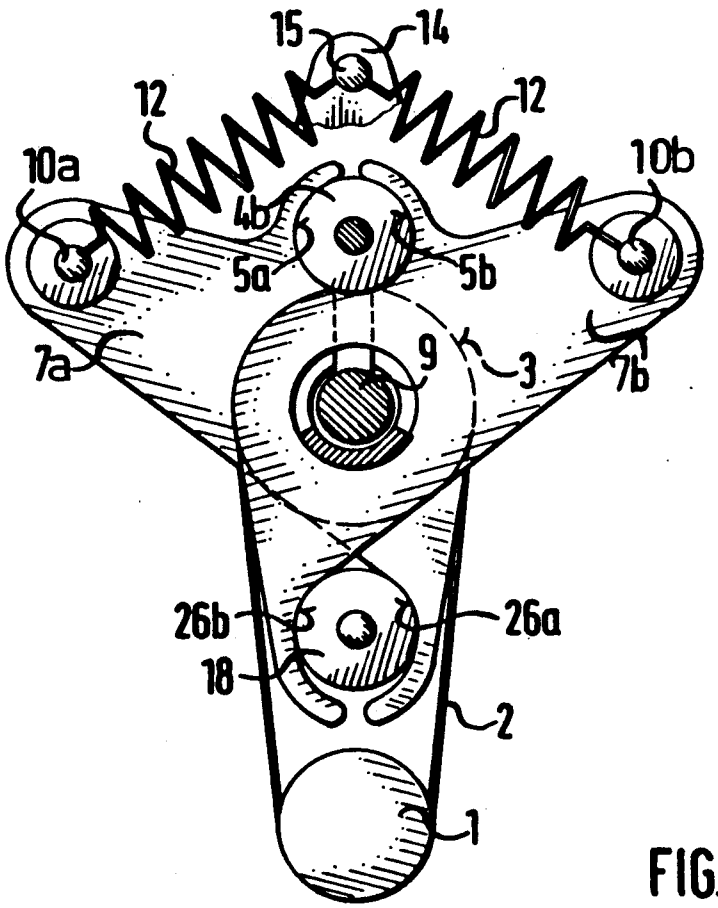

As seen in FIGS. 1, 2A, and 2B an actuator for a step transformer 8 has a support housing 13 normally secured underneath the transformer 8 and carrying an upright output shaft 9 rotatable about and centered on a vertical axis A and fixed to the rotor of this transformer 8. A stepping-type drive motor 20 has an output shaft carrying a drive pulley 1 connected via a belt 2 to an input pulley 3 that carries lower and upper input wheels 3a and 3b that are rotatable on the shaft 9 about the axis A. The motor 20 operates to drive the input elements 3, 3a, and 3b in 90° steps.

An arm 16 fixed to and extending radially from the shaft 9 between the input wheels 3a and 3b carries on its outer end an entrainment element 18 formed as an elastomeric bumper or roller of cylindrical shape centered on a vertical axis. In addition the shaft 9 carries above the upper input wheel 3b an output wheel 17 having an outer edge provided with two lower and two upper radially projecting teeth 25a and 25b. This wheel 17 is fixed on the shaft 9 like the arm 16.

Figure 3:
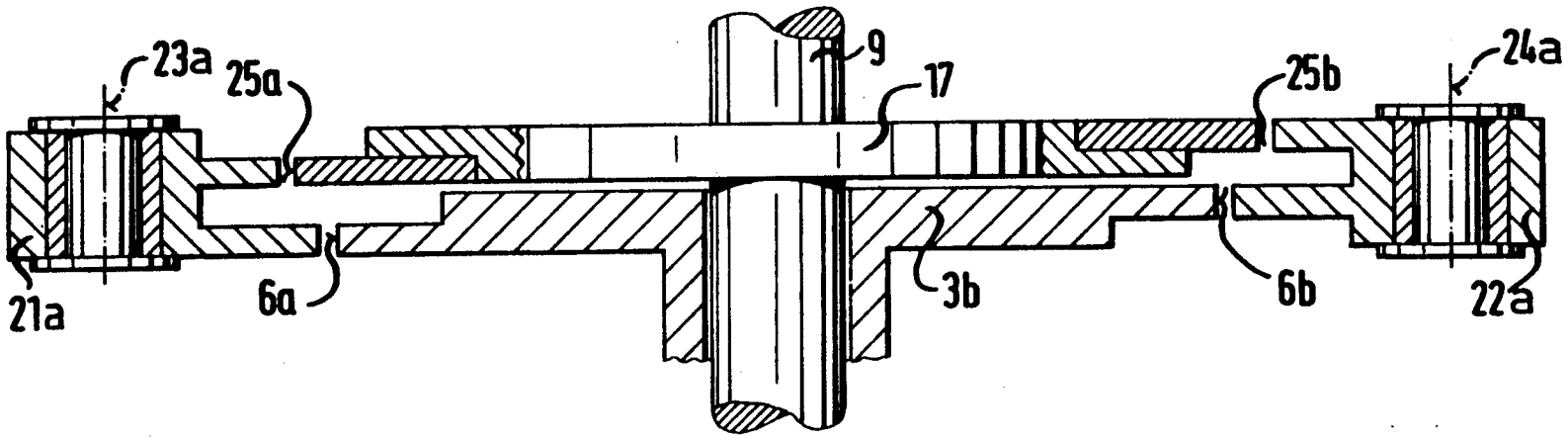
FIG. 3 is a vertical axial section through a portion of the apparatus.

The housing 13 carries on diametrically opposite sides two pairs of latch pawls 21a, 21b and 22a, 22b pivotal on respective upright pivot pins 23a, 23b, and 24a, 24b. Each such pawl has as shown in FIG. 3 an upper arm engageable on the level of the output wheel 17 with one of the pairs of teeth 25a and 25b and a lower arm engageable with an upper or lower cam edge 6a or 6b formed on the upper input element 3b. FIG. 2b shows how the pair of pawls 22a and 2b is pushed out by the upper cam formation 6b to be clear of the upper teeth 25b while the other pair of pawls 21a and 21b is engaged inward and braced against opposite sides of the tooth 25a, rotationally blocking the wheel 17 and shaft 9 against rotating.

Figure 4:
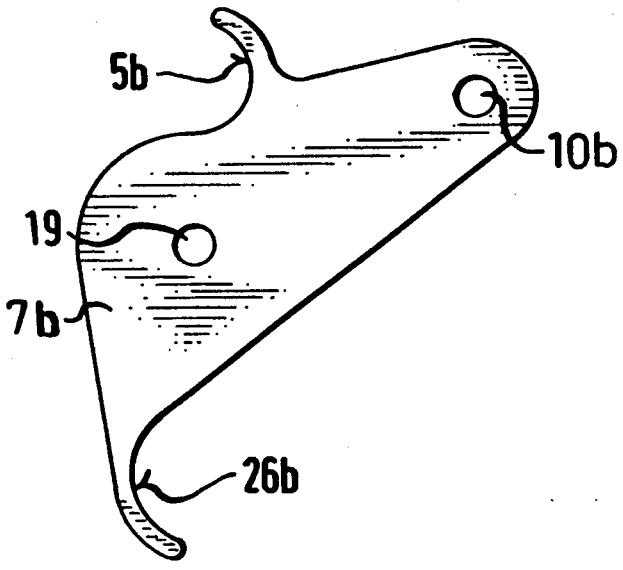
FIG. 4 is a top view of the two force-storing levers.
Figure 4:
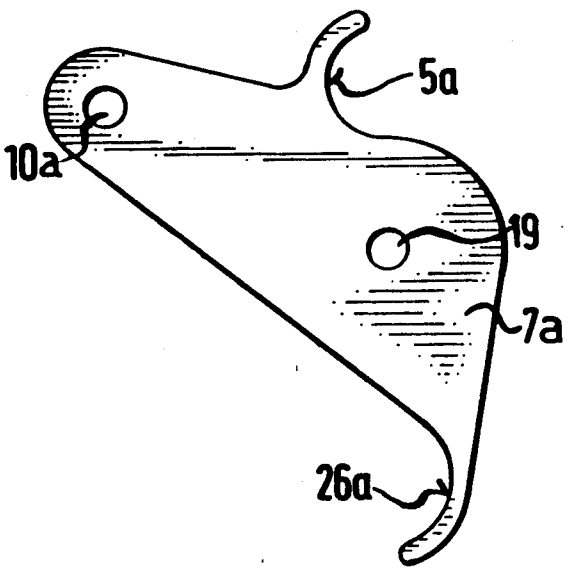

Lower and upper force-storing levers 7a and 7b that can rotate freely about the axis A are provided between the input wheels 3a and 3b to rotationally couple the input elements 3, 3a and 3b to the output elements 9, 17, and 18. As best seen in FIG. 4 these levers 7a and 7b are formed with holes 19 through which pass the shaft 9 and connecting collar of the input elements 3–3b and with a seats 5a and 5b open angularly in opposite directions and with seats 27a and 26b open angularly oppositely to the respective seats 5a and 5b. An entrainment element 4a formed like the element 18 is provided atop the lower input wheel 3a and can engage in the seat 5a of the lever 7a and another such element 4b projecting down underneath the upper wheel 3b can engage in the seat 5b of the lever 7b. Both seats 26a and 26b can engage around the element 18 fixed on the shaft 9.

A coil spring 12 has outer ends secured at 10a and 10b on the outer ends of the levers 7a and 7b and a middle secured at 15 on a spring arm 14 that can pivot freely about the axis 9 between the levers 7a and 7b. Thus the two end sections of this spring 12 always extend tangentially of the axis A between the middle 15 and the two end points 10a and 10b.

The device described above operates as follows:

To start with the parts are in the position of FIGS. 1, 2A, and 2B. More particularly the pawls 21a and 21b are locked against opposite sides of the tooth formation 25a to rotationally lock the wheel 17 and shaft 9 in the housing 13 while the pawls 22a and 22b are held out of contact with the teeth 25b by the cam edge 6b. The entrainment elements 4a and 4b, which are always centered on a common axis A' offset from but parallel to the axis A, are diametrically opposite relative to the axis A of the output element 18. The spring 12 is slightly tensioned to hold the arm 14 in a position bisecting the angle between the two end points 10a and 10b.

Figure 2D:
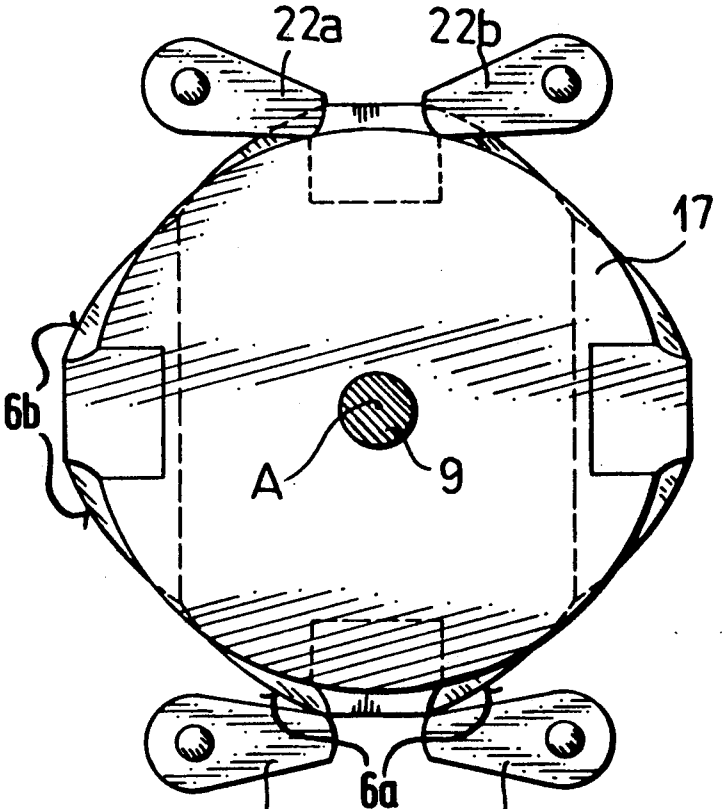
FIGS. 2C and 2D are views like FIGS. 2A and 2B, respectively, but with the parts in partially stepped or actuated positions.
Figure 2C:
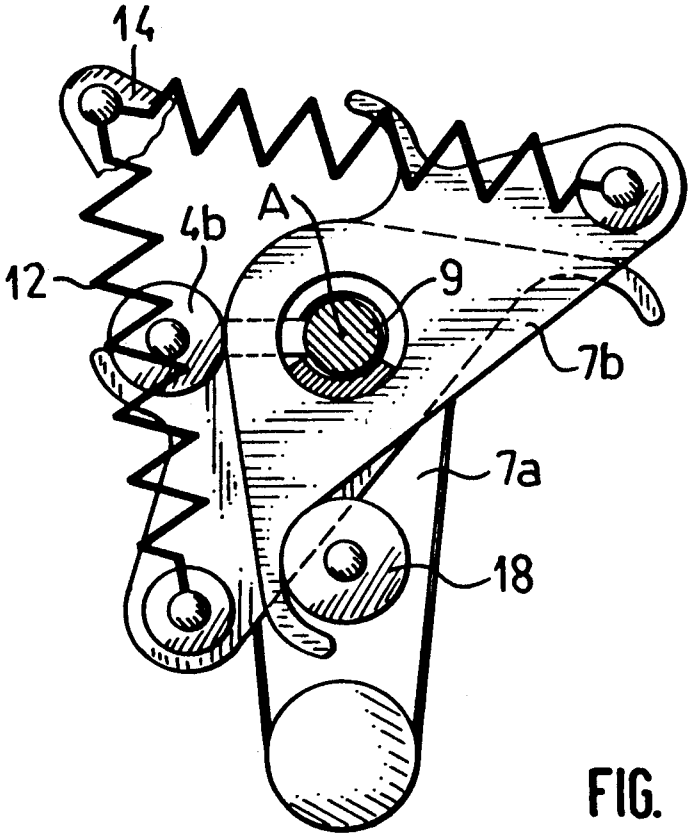

Rotation of the input element 3, 3a, and 3b counterclockwise as seen from above and in FIGS. 2C and 2D will cause the lever 7b to rotate counterclockwise as the element 4b pushes the seat 5b back. This action is accompanied by tensioning of the spring 12 and shifting of the arm 14. The cam 6a will move out the pawls 21a and 21b, but the pawls 22a and 22b will engage the opposite tooth 25b to continue to rotationally lock the shaft 9 and output wheel 17.

Figure 2F:
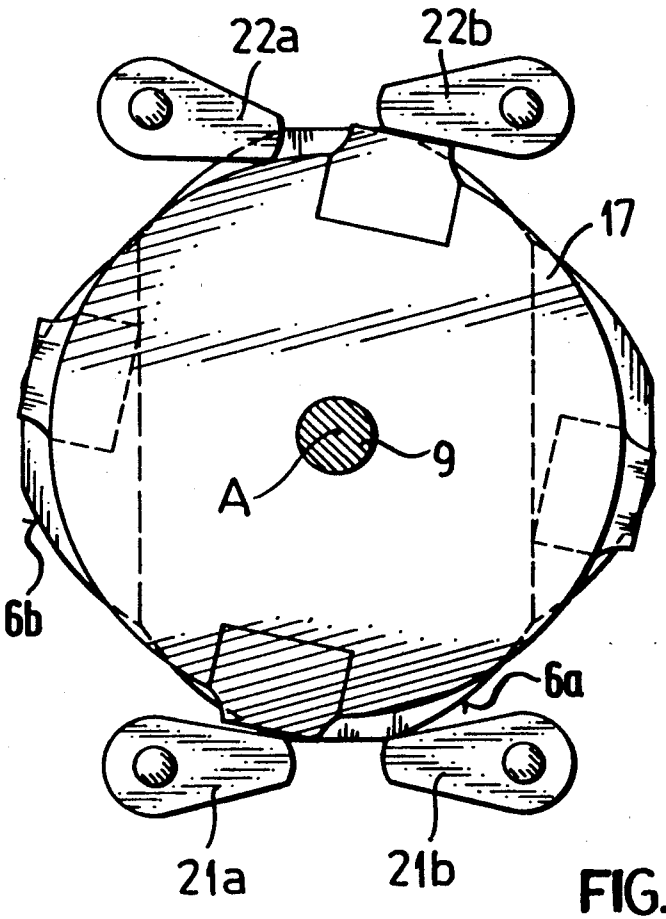
FIGS. 2E and 2F are views like FIGS. 2A and 2B, respectively, but with the parts nearly in the end position.
Figure 2E:
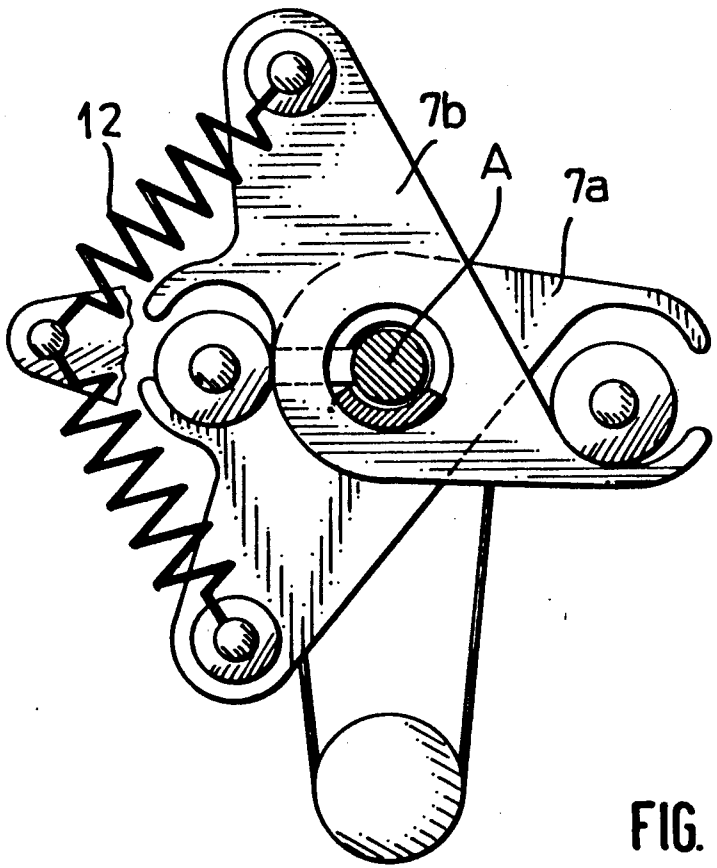

Just before the input elements 3, 3a, and 3b have turned through 90° as seen in FIGS. 2E and 2F, the cams 6a nd 6b release all of the pawls 21a, 21b, 22a, and 22b to allow the spring 12 to swing the output wheel 17 around to follow the input elements 3, 3a, and 3b. To do this the spring 12 pulls the lever 7b which cradles the element 18 in its seat 26b so that this lever 7b entrains the element 18, the arm 16, and the shaft 9. The pawls 21a and 21b will, however relock the wheel 17 after 90° of revolution, returning the system basically to the starting position, but with the rotary parts all offset by 90° from this starting position.

Once thus advanced one 90° step, the actuator can be stepped in either direction with identical results. Thus the action is not direction-dependent, any possible sequence of right- and left-hand rotations can be effected without problems.

I claim:

1. A force-storing actuator for connection to a rotor of a step transformer, the actuator comprising:

a support;

a central upright axle connected to the rotor, defining an axis, and rotatable on the support about the axis;

upper and lower input wheels fixed rotationally to each other and rotatable on the shaft about the axis;

respective upper and lower drive elements fixed respectively underneath and atop the upper and lower input wheels;

upper and lower force-storing levers rotatable on the shaft about the axis between the input wheels and respectively juxtaposed with the upper and lower input wheels, each lever being angularly engageable with the respective drive element;

a spring arm rotatable on the shaft about the axis between the upper and lower levers and having an outer end;

a spring having outer ends connected to the two levers offset from the axis and a middle secured on the outer end of the spring arm;

an output wheel fixed on the shaft above the upper input wheel;

an output element fixed angularly on the shaft axially between the levers and engageable angularly with both of the levers;

latching formations on the output wheel;

at least one latch pawl movable on the support between a blocking position latchingly engaging the formations to angularly arrest the output wheel and a freeing position out of engagement with the output wheel;

cam means on the upper drive wheel engageable with the pawl for displacing same between its positions; and drive means for rotating the input wheels with the pawl in the blocking position for tensioning the spring and for bringing the cam means into engagement with the pawl to displace it briefly into the freeing position to allow rotation of the output wheel and shaft and relaxation of the spring.

2. The step-transformer actuator defined in claim 1 wherein the levers are spectrally identical.

3. The step-transformer actuator defined in claim 1 wherein the cam means includes an upper cam edge and a lower cam edge on the upper drive wheel.

4. The step-transformer actuator define din claim 1 wherein the latching formations include upper and lower formations on the output wheel.

5. The step-transformer actuator defined in claim 1 wherein each of the latch pawls has an upper arm engageable with a respective one of the formations and a lower arm engageable with a respective one of the cam edges.

6. The step-transformer actuator define din claim 1 wherein the drive and output elements are elastomeric bumpers.

7. The step-transformer actuator defined in claim 1 wherein the spring lever is freely pivotal about the axis.

8. The step-transformer actuator defined in claim 1 wherein the input wheels are substantially identical.

* * * * *